US006348849B1

(12) United States Patent
Kruse et al.

(10) Patent No.: US 6,348,849 B1
(45) Date of Patent: Feb. 19, 2002

(54) HIGH VOLTAGE TRANSFORMER

(75) Inventors: Neils Andreas Kruse, Cary; Sam James Cicero, Island Lake; Steve Wayne Enot, Algonquin; John M. Rein, Elgin, all of IL (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/630,129

(22) Filed: Aug. 1, 2000

(51) Int. Cl.[7] ..... H01F 27/28
(52) U.S. Cl. ..... 336/198; 336/192
(58) Field of Search ..... 336/90, 96, 198, 336/192, 185, 200, 107

(56) References Cited

U.S. PATENT DOCUMENTS 2,633,481 A * 3/1953 Meeks ..... 336/200
3,590,480 A 7/1971 Johnson et al.
3,601,725 A 8/1971 Bercovici et al.
4,547,961 A 10/1985 Bokil et al.
4,677,538 A * 6/1987 Brodzik et al. ..... 336/200
5,055,816 A 10/1991 Altman et al.
5,214,403 A * 5/1993 Bogaserts et al. ..... 336/84
5,245,746 A 9/1993 Stokes
5,696,477 A * 12/1997 Yamamori et al. ..... 336/192

* cited by examiner

*Primary Examiner*—Lincoln Donovan
*Assistant Examiner*—Tuyen Nguyen
(74) *Attorney, Agent, or Firm*—Terry J. Anderson; Karl J. Hoch, Jr.

(57) ABSTRACT

A transformer that prevents breakage of the wire leads thereof. The transformer comprising a generally cylindrical bobbin having a plurality of windings wrapped therearound. Each of the windings has a respective first and second end. Attached to an end of the bobbin is a bobbin endplate having a plurality of first and second end lead breakouts disposed thereon. Accordingly, respective ones of the first ends are attached to respective first end lead breakouts and respective ones of the second ends are attached to respective second end lead breakouts in order to prevent breakage of the windings.

17 Claims, 2 Drawing Sheets

HIGH VOLTAGE TRANSFORMER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to transformers and more particularly to a transformer which prevents lead breakage of the wire coil.

Typically, a transformer is formed by wrapping layers of wire around a cylindrical bobbin. In this respect, a first layer of wire is wrapped around the bobbin and at least one other layer is wrapped thereover. By varying the turns between the layers, it is possible to vary the voltage across each winding.

On encapsulated transformers, the leads of the wire layers are prone to breakage where they exit the encapsulation material. Specifically, the encapsulation material is typically a resin which is poured over the layers of wire. The ends of the wire must exit this encapsulation material in order to be attached to a power source and/or load. The typical approach for preventing breakage of the wire leads is to solder a insulated, stranded wire to the wire layer wrapped around the bobbin. The solder connection with the insulated stranded wire is covered with the encapsulation material and provides flexibility and strain relief for the wire layer wrapped around the bobbin of the transformer.

However, a problem exists in the fact that the solder connections and additional insulation tape of the stranded wire increases the coil diameter of the transformer. Accordingly, when many secondary windings are used on the transformer (i.e., in high voltage transformer design), reliability is decreased while manufacturing costs are increased. Additionally, the insulated stranded wire must be soldered by hand such that automated manufacturing processes may not be used to make the transformer.

The present invention addresses the above-mentioned deficiencies in the prior art transformer design by providing a new bobbin design which increases reliability and improved production yields with lower manufacturing costs. In this respect, the transformer with the novel bobbin design of the present invention allows for automated wire bonding to the finished transformer assembly thereby reducing manufacturing costs and increasing yields.

BRIEF SUMMARY OF THE INVENTION

An improved high voltage transformer comprising a generally cylindrical bobbin. A plurality of windings, each with a respective first and second end, are wrapped around the bobbin. Attached in generally perpendicular relation to the bobbin is a bobbin end plate. Disposed on the bobbin end plate are a plurality of a first end lead breakouts and a plurality of second end lead breakouts. In this respect, respective ones of the first ends of the wire are attached to respective ones of the first end lead breakouts while respective ones of the second end of the wires are attached to respective ones of the second end lead breakouts in order to prevent breakage of the windings.

In accordance with the preferred embodiment of the present invention, the bobbin end plate is a printed wiring board such that the first and second end lead breakouts are formed from etched copper traces. The transformer further includes a core disposed about the windings. Additionally, an encapsulation layer is disposed over the windings and insulation is disposed between each layer of winding.

In order to facilitate attachment of a power supply and/or a load to the transformer, the transformer further comprises a plurality of winding termination pads disposed on the bobbin end plate. Additionally, the transformer will include a plurality of winding termination traces disposed on the bobbin end plate which are in electrical communication with respective ones of the winding termination pads. Each of the winding termination traces is in electrical communication with a respective one of the first end lead breakouts or a respective one of the second end lead breakouts. Each of the winding termination pads are disposed on a peripheral edge of the bobbin in order to facilitate attachment of a load or power supply thereto.

In accordance with the present invention there is a method of forming an improved high voltage transformer. The method comprises winding a first layer of wire around a bobbin having an end plate. Next, a first end of the wire is attached to a first end lead breakout of the end plate and a second end of the wire is attached to a second end lead breakout of the end plate. By attaching the first and second ends to respective first and second lead breakouts, breakage of the wire is prevented. It will be recognized that subsequent layers of wires may be wrapped around the bobbin and respective first and second ends thereof are attached to respective first and second lead breakouts of the bobbin endplate. In order to finish the transformer, the layers of wire may be encapsulated by a material and a core may be disposed thereover.

BRIEF DESCRIPTION OF THE DRAWINGS

These as well as other features of the present invention will become more apparent upon reference to the drawings wherein.

DETAILED DESCRIPTION OF THE INVENTION

Figure 1:
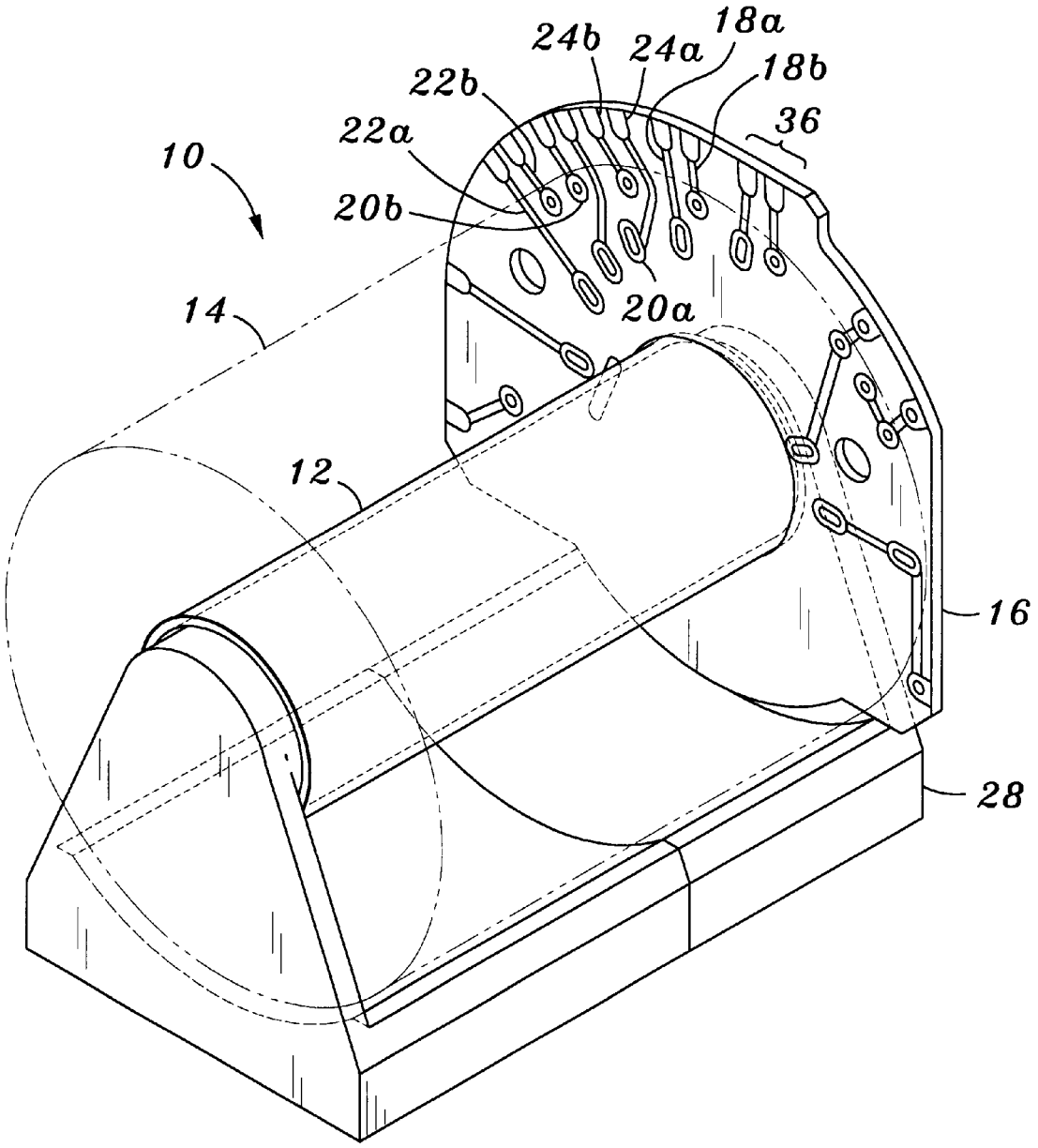
FIG. 1 perspectively illustrates a transformer constructed in accordance with the present invention.
Figure 3:
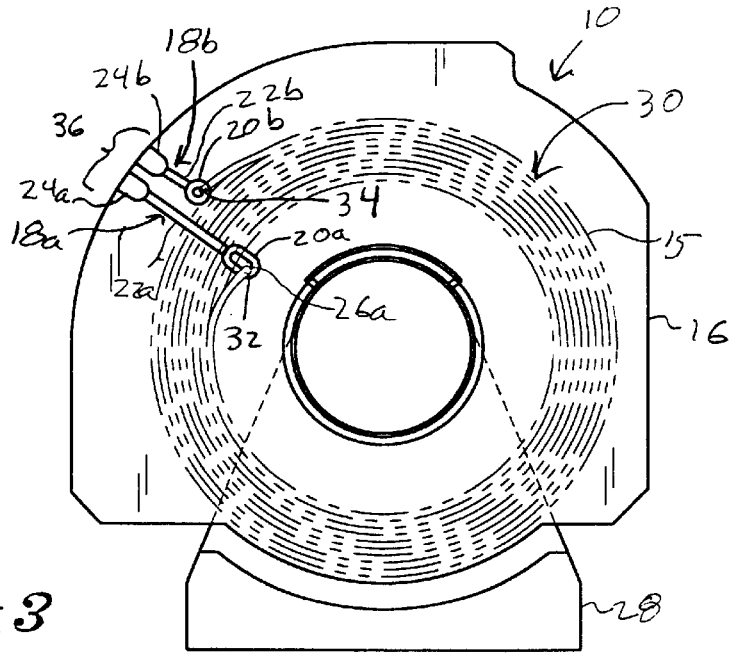
FIG. 3 is an elevational view depicting one layer of wire wrapped around the bobbin of the transformer shown in FIG. 1 and attached to the end plate shown in FIG. 2.

Referring now to the drawings wherein the showings are for purposes of illustrating a preferred embodiment of the present invention only, and not for purposes of limiting the same, FIG. 1 perspectively illustrates a improved high voltage transformer 10 of the present invention. The transformer 10 includes a generally cylindrical bobbin 12 surrounded by a wire coil 14. The wire coil 14 is wrapped around the bobbin 12 and comprises multiple windings of wire 15, as seen in FIG. 3. In this respect, the wire coil 14 is fabricated by wrapping the wire 15 around the exterior of the bobbin 12 to form a first layer and then wrapping at least another layer of wire 15 over the first layer. Each subsequent layer of wire is wrapped over a preceding layer. In the preferred embodiment, a layer of insulating material may be placed between each layer of wire 15. The layer of insulation prevents the layers of wire 15 from short circuiting.

As seen in FIG. 1, the transformer 10 further includes bobbin endplate 16 attached to one end of the bobbin 12. In this respect, the endplate 16 is generally perpendicular to a longitudinal axis of the bobbin 12. The endplate 16 is fabricated from a printed wiring board (PWB). The bobbin 12 is attached to the end plate 16 through conventional bonding techniques, such as an adhesive.

Figure 2:
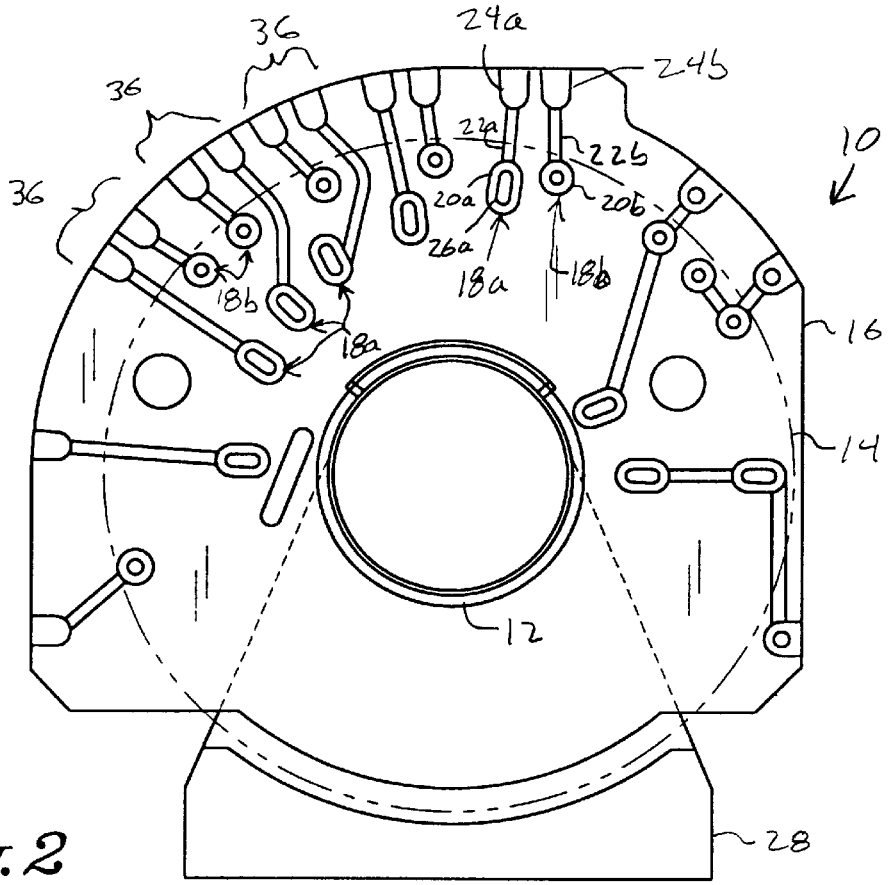
FIG. 2 is an elevational view showing the end plate for the transformer shown in FIG. 1.

Formed on the end plate 16 are a plurality of wire lead breakouts 18*a*, 18*b* as seen in FIG. 2. Each of the wire lead breakouts 18*a*, 18*b* has a respective wire connection pad 20*a*, 20*b*, a trace segment 22*a*, 22*b*, and a termination pad 24*a*, 24*b*. The wire lead breakouts 18*a*, 18*b* provide a pathway for electrical energy to be communicated to the layers of the wire coil 14. In this respect, each of the wire lead breakouts 18*a*, 18*b* is formed from etched copper traces fabricated on the endplate 16. Accordingly, each of the wire lead breakouts 18*a*, 18*b* may be formed through conventional printed wiring board construction techniques. Additionally, because each of the wire connection pads 20 and termination pads 24 are formed from etched copper traces, it is simple to solder wire thereto, as will be further explained below.

In addition to the foregoing, the transformer 10 constructed in accordance with the preferred embodiment of the present invention, further includes a core 28 mated with the coil 14 and end plate 16. Additionally, the wire coil 14 is encapsulated by a material such as a thermoplastic. In this respect, the coil 14 is protected and covered by the encapsulation material, but the ends of the wire coil 14 are exposed and attached to endplate 16, as will be further explained below.

As will be recognized in transformer design, typically a primary winding is first wrapped around the bobbin 12 and then secondary windings are wrapped thereover. Referring to FIG. 3, each secondary winding, as well as the primary winding, has a first end 32 and a second end 34 attached to a respective one of the wire lead breakouts 18*a*, 18*b*. In this respect, wire lead breakouts 18a are typically used for the first end 32 of wire 15 wrapped around bobbin 12, whereas wire lead breakout 18*b* is used for the second end 34. Accordingly, wire lead breakouts 18*a*, 18*b* form a wire lead breakout set 36. As will be recognized by those of ordinary skill in the art, as the windings of the wire coil 14 are wrapped around the bobbin 12, the diameter of the coil 14 increases. In order to accommodate for the increasing diameter of the coil 14, each set of wire lead breakouts 36 is staggered outwardly from a previous set. In this respect, the set of wire lead breakouts 36 form a spiral pattern, as seen in FIG. 2.

As seen in FIG. 3, the wire lead breakout 18*a* for the first end 32 of wire 15 comprises a wire connection pad 20*a*, a trace segment 22*a*, and a termination pad 24*a*. The wire connection pad 20*a* has a respective aperture 26*a* formed therein which is elongated in order to allow for variations in the diameter of the wire coil 14. Accordingly, wire 15 may be inserted through aperture 26*a* and soldered to wire connection pad 20*a*. As seen in FIG. 3, the trace segment 22*a* electrically connects the wire connection pad 20*a* with termination pads 24*a*. Similarly, each wire lead breakout 18*b* has a respective wire connection pad 20*b* in electrical communication with a trace segment 22*b* and termination pad 24*b*. Therefore, it is possible to be in electrical communication with the single layer 30 of wire 15 via termination pads 24*a* and 24*b*. In this respect, each set of wire lead breakouts 36 provide attachment points for the first end 32 and second end 34 of wire layer 30. As will be recognized, by using termination pads 24*a*, 24*b* to attach to respective ends 32, 34 of wire 15, it is possible to avoid breakage of the wire 15 exiting the encapsulation material of the transformer 10.

In the preferred embodiment of the present invention, the transformer 10 is fabricated by placing the bobbin 12 on an arbor and winding a first layer wire 15 therearound. The first end 32 of the first wire coil will be soldered to a respective one of the wire connector pads 20*a* for a respective wire lead breakout set 36. The finish of the first wire coil will be left unterminated. Next, additional windings (i.e., secondary windings) of wire 15 are wound on top of previous windings. The start (i.e., first end 32) of each subsequent winding is soldered to a respective wire connector pad 20*a*. In order to avoid short circuiting between the layers of windings, insulation is added therebetween during winding. Once the layers have been wound, the finish end (i.e., second end 34) of each layer is soldered to a respective wire connector pad 20*b*. As seen in FIG. 2, the second ends 34 of the wire connector pads 20*b* are disposed in generally equal radial relation to on another such that they can be accessed after the wire coil 14 has been wound around the bobbin 12. Once the wires 15 of the wire coil 14 have been soldered to respective ones of the wire connector pads 20*a*, 20*b*, the wire coil 14 is encapsulated to cover the wire coil 14, but not the exposed termination pads 24*a*, 24*b*. Finally, the encapsulated wire coil 14 is mated with the core 28 and the transformer 10 is complete.

By using the end plate 16 with wire lead breakouts 18, fabrication of a transformer 10 with encapsulated wire coil 14 avoids the problems associated with the prior art transformers of lead breakage. Additionally, the endplate 16 allows for automated wire bonding to the transformer 10 thereby reducing manufacturing costs. Therefore, it is possible to construct the transformer 10 of the present invention using automated techniques thereby reducing the cost of the transformer 10.

Additional modifications and improvements of the present invention may also be apparent to those of ordinary skill in the art, such as using two end plates 16 for facilitating connection to the wire coil 14. Thus, the particular combination of parts described and illustrated herein is intended to represent only a certain embodiment of the present invention and is not intended to serve as a limitation of alternative devices within the spirit and scope of the invention.

What is claimed is:

1. A transformer comprising:

a substantially cylindrical bobbin;

a plurality of windings wrapped around the bobbin, each of the windings having a respective first end and a respective second end;

a bobbin endplate attached to the bobbin;

a plurality of first end lead breakouts disposed on the bobbin endplate; and a plurality of second end lead breakouts disposed on the bobbin endplate;

wherein respective ones of the first ends are attached to respective first end lead breakouts and respective ones of the second ends are attached to respective second end lead breakouts.

2. The transformer of claim 1 wherein the bobbin endplate is a printed wiring board.

3. The transformer of claim 1 wherein the second end lead breakouts and the first end lead breakouts are formed from etched copper traces.

4. The transformer of claim 1 further comprising a core disposed about the windings.

5. The transformer of claim 1 further comprising an encapsulation layer disposed over the windings.

6. The transformer of claim 1 further comprising multiple layers of insulation disposed between respective windings.

7. The transformer of claim 1 wherein each of the first and second lead breakouts comprise:

a winding termination pad disposed on the bobbin endplate;

a trace segment disposed on the bobbin endplate and in electrical communication with the winding termination pad; and a wire connection pad in electrical communication with the trace segment;

wherein each of the wire connection pads is in electrical communication with respective ones of the first and second ends of the wire wrappings.

8. The transformer of claim 7 wherein the bobbin has a peripheral edge and the winding termination pads are disposed on the peripheral edge in order to facilitate attachment thereto.

9. The transformer of claim 1 wherein the bobbin has a longitudinal axis and the endplate is attached substantially perpendicular to the longitudinal axis thereof.

10. The transformer of claim 1 wherein each of the first and second end lead breakouts is staggered outwardly from a previous one.

11. The transformer of claim 1 wherein the first and second end lead breakouts form a pattern on the endplate to accommodate for increasing diameter of the windings.

12. A transformer comprising:

a bobbin;

an endplate attached to the bobbin;

a wire wrapped around the bobbin, the wire having a first end; and a wire lead breakout disposed on the endplate;

wherein the first end of the wire is attached to the wire lead breakout.

13. The transformer of claim 12 wherein the endplate is fabricated from printed wiring board.

14. The transformer of claim 13 wherein the wire lead breakout is an etched copper trace of the printed wiring board.

15. The transformer of claim 12 wherein the wire lead breakout comprises a termination pad, a trace segment and a wire connection pad for facilitating connection of the wire.

16. The transformer of claim 12 wherein the bobbin has a longitudinal axis and the endplate is attached to the bobbin substantially perpendicular to the longitudinal axis.

17. The transformer of claim 12 wherein the wire further includes a second end and the endplate further includes a second wire lead breakout for attachment of the second end of the wire.

* * * * *